United States Patent [19]

Wendt et al.

[11] 4,403,335

[45] Sep. 6, 1983

[54] ARRANGEMENT FOR THE SELF-WIPING OF CONTACTS IN MULTIDIGIT INTERROGATING COUNTERS

[75] Inventors: Hans-Joachim Wendt, Villingen Schwenningen; Helmut Müller, St. Georgen, both of Fed. Rep. of Germany

[73] Assignee: Kienzle Apparate GmbH, Villingen, Fed. Rep. of Germany

[21] Appl. No.: 206,355

[22] Filed: Nov. 13, 1980

[30] Foreign Application Priority Data

Nov. 16, 1979 [DE] Fed. Rep. of Germany ..... 2946254

[51] Int. Cl.[3] ..... H01H 1/60

[52] U.S. Cl. ..... 377/87; 200/11 G; 200/164 R; 200/242; 200/253

[58] Field of Search ..... 235/92 EA, 92 C, 132 E; 200/242, 253, 11 G, 11 TW, 11 DA, 17 R, 18, 36, 37 R, 156, 164 R, 292; 377/82–92

[56] References Cited

U.S. PATENT DOCUMENTS 3,011,114 11/1961 Steeb ..... 200/11 G
3,548,166 12/1970 Sebastian ..... 235/92 EA

FOREIGN PATENT DOCUMENTS 140487 of 1903 Fed. Rep. of Germany ..... 200/253
7312470 7/1973 Fed. Rep. of Germany .

*Primary Examiner*—Joseph A. Orsino, Jr.
*Attorney, Agent, or Firm*—Toren, McGeady and Stanger

[57] ABSTRACT

An arrangement for the self-wiping of contacts in multidigit interrogatory counters where the data are read through code wheels to contact wheels and to mechanical sliding contacts which sense the contact wheels. The improvement includes the arranging of the rotatably-mounted contact wheels to be mounted, independently from the frictional effect caused by the counting procedure during rotation on a movable shaft. Eccentrics control the movement of the movable shaft which make it possible to move the contact wheels in an oscillating manner against contact springs. This is accomplished in the overlap region for sensing the individual numbers.

4 Claims, 3 Drawing Figures

ARRANGEMENT FOR THE SELF-WIPING OF CONTACTS IN MULTIDIGIT INTERROGATING COUNTERS

FIELD OF THE INVENTION

The invention relates to an arrangement for the self-wiping of contacts in multidigit interrogating counters, in which the counter reading data are preferably read through code wheels to contact wheels and to mechanical sliding contacts which sense the contact wheels.

BACKGROUND OF THE PRIOR ART

As is well known, safety in assuring contact effectiveness can be increased to a certain extent by the application of a number of mechanical measures. A frequently used arrangement for increasing switching safety resides, for example, in the arrangement of double contact springs or, very generally, in the arrangement of contacts in parallel connection. A prerequisite for reducing switching errors is provided by hunting contacts, however, this measure remains ineffective if the contact and contact surfaces always touch each other on the same surface region.

As a result of environmental influences, there are formed, for example, contaminated areas which, over time, have the effect of an insulating layer which will lead to switching errors. This error effect occurs in counter mechanisms which can be interrogated in the range of the upper counting decades whose settings are relatively rarely changed because generally low counting amounts occur. To counteract such disadvantageous phenomena, jumping contact springs are sometimes used. In using contact springs, fatigue phenomena in the resilient part of the contact arm already become apparent after relatively short periods of operation, so that the remaining contact spring pressure is no longer sufficient to achieve a satisfactory making of contact. A general increase of the contact pressure also leads only to a temporary improvement of the conductive connection and, on the other hand, leads to an increased load with respect to the drive torque.

Additional measures for improving the making of contact include the use of high-grade contact material which, of course, leads to a substantial increase in costs, especially when it is a multidigit interrogating device. It is in most cases not possible to simultaneously take into consideration all the measures mentioned thus far because of the questions of costs and space. In mechanical interrogating counters with low switching frequency, all of the above-mentioned measures have the disadvantage that sliding contacts of the higher decades with lower switching frequency are not kept ready to operate by means of self-wiping.

OBJECTION OF THE INVENTION

It is a primary object of the invention to provide, in interrogating counters of the above-mentioned type, a simple arrangement for the substantial elimination of the uncertainties in the making of contact at the time of interrogation.

SUMMARY OF THE INVENTION

In accordance with the invention, the primary object is met thereby that the rotatably mounted contact wheels are supported, independently from the friction effect caused by the counting procedure during the rotation, on a movable shaft which can be controlled by means of eccentrics, the contact wheels being movable in an oscillating manner by means of the shaft against contact springs in the overlap region, capable of sensing the individual numbers.

For a better understanding of the present invention, reference is made to the following description and accompanying drawings, in which the scope of the present invention will be pointed out in the appended claims.

DESCRIPTION OF THE PREFERRED EMBODIMENT

Figure 1:
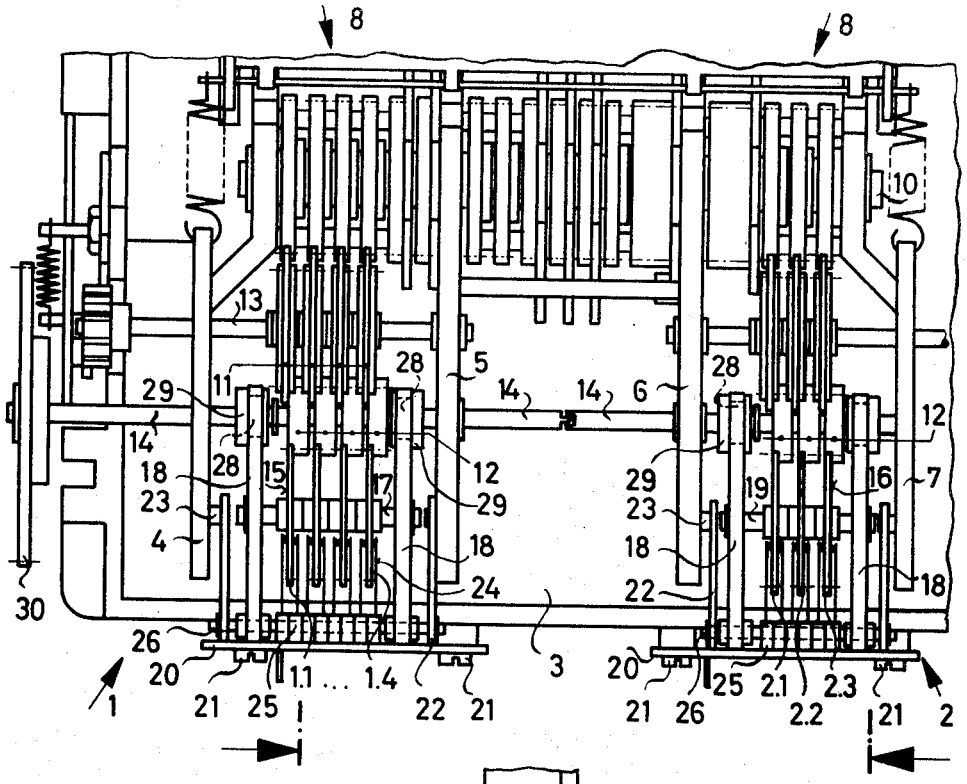
FIG. 1 shows a detail from a printing counter mechanism with a multidigit interrogating counter.
Figure 3:
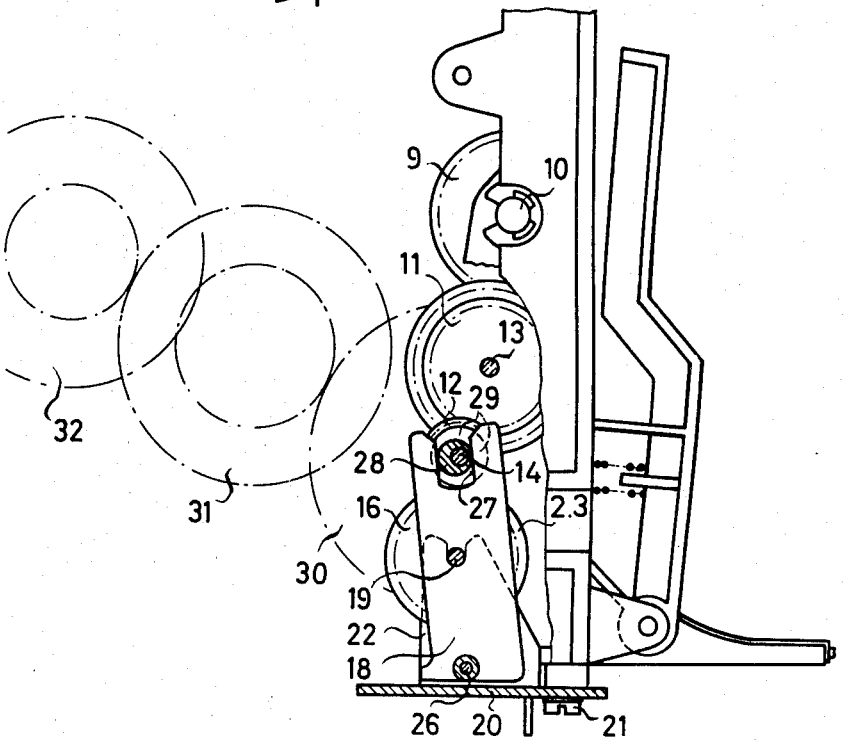
FIG. 3 shows the device controlled by means of eccentrics for the mutual movement of the contact elements.
Figure 2:
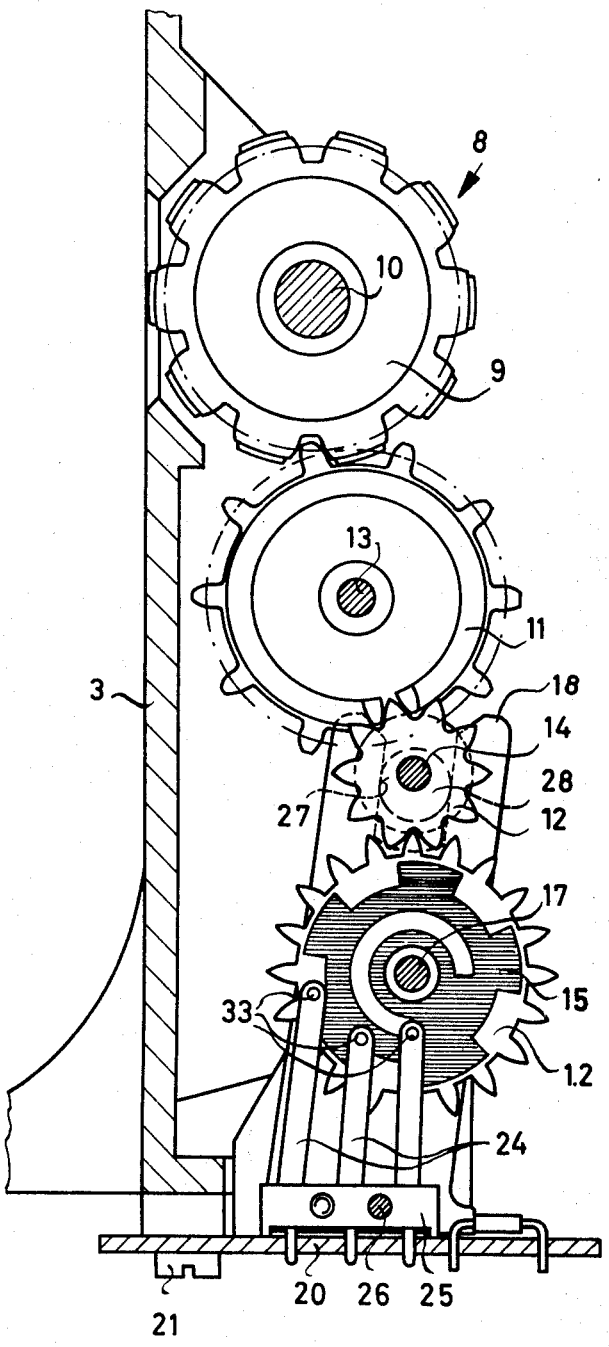
FIG. 2 is a sectional view of a detail of a decimal from the arrangement according to FIG. 1.

The embodiment shown in FIGS. 1 to 3 for illustrating the invention is a continuously driven counter and printing mechanism which is equipped, in the manner of auxiliary equipment, for example, with two interrogating counters 1 and 2. In the above-indicated case, these interrogating counters 1 and 2 serve, in a device for delivering liquids, for the registration of units of delivered quantities by the interrogating counter 1 and of a consecutive lot number by the interrogating counter 2. The range of this application already makes clear that, for the individual lots of the four-digit counter 1 for the delivered quantity, the upper decimal digits according to 1.3, 1.4 are used very rarely or practically not at all beyond the full counting capacity.

The interrogating counter 2 has a three-digit capacity and continuously registers, for example, the individual discharge lots. In this connection, it is quite obvious that, with an average frequenting of a discharge point, the decimal digit according to position 2.3 for the hundred units remains totally inactive over long periods of time; in the normal case, an insulating layer forms in the meantime due to contamination, oxidation and similar phenomena.

For the explanation of the construction of a decimal in the sectional view, reference is made to FIG. 2. All components of the printing counter mechanism unit with the interrogating counters 1 and 2 are arranged on a base plate 3 between integrally connected side walls 4, 5, 6, 7. The counting printing mechanism 8 consists of type wheels 9 which are arranged in decades on a shaft 10. The type wheels 9 are driven or adjusted continuously during the counting procedure by a gear drive mechanism, not shown in detail, and the type wheels 9 are aligned in integer numbers prior to printing.

The adjusting motion of the type wheels 9 is transmitted through gears 11 arranged on the shaft 13 and through gears 12 rotatably mounted on a shaft 14 to contact wheels 1.1, 1.2, 1.3, 1.4 and 2.1, 2.2, 2.3 which have teeth at their peripheries (FIGS. 1 and 2). The contact wheels 1.1 to 1.4 and 2.1 to 2.3 consist of insulating material and are on both end faces provided with copper-coated coding wheels 15, 16. The coding wheels 15, 16 are designed, for example, for a five-channel code. The contact wheels 1.1 through 1.4 are rotatably mounted on a shaft 17 which is received in swinging support arms 18. In the identical manner, contact wheels 2.1, 2.2, 2.3 are received by a shaft 19 which is also supported in the same support arms 18.

A printed circuit board 20 simultaneously serves as a base plate for the interrogating counters 1 and 2 and is rigidly connected at a right angle to the base plate 3 by means of screws 21. Support members 22 are provided for the exact fixing of the interrogating counters 1, 2 on the base plate 3; the support members 22 engage with fork-like recesses in bolts 23 on the base plate 3. The contat wheels 1.1 to 1.4 and 2.1 to 2.3 are under contact pressure which acts in axial direction to both sides between the contact springs 24. The contact springs 24 are cast into blocks 25 of insulating material and are held rigidly to the frame between support members 22 by means of an insertable shaft 26.

Similarly, the shaft 26 serves as the bearing for the support arms 18 which swing on the shaft 26 through a relatively small angular range. At their other ends, the support arms 18 are provided with a parallel guide 27 recessed in the form of a fork which engage in eccentrics 28 which are nonrotatably fastened on a shaft 14. For the axial locking or for ensuring optimum lateral guidance of the support arms 18, the eccentrics 28 are provided with flanges 29 which cover the parallel guide 27 on both sides. The shaft 14 with the eccentrics 28 which is rotatably supported in the side walls 4, 5, 6, 7, is laterally extended and at its end has a gear 30 which, through a reduction gear unit consisting of the gears 31, 32, is in direct drive connection with a rotation drive mechanism which is not shown in detail and is controlled by a measuring unit. Due to the drive connection chosen in this manner, the shaft 14 is constantly moved during each discharge or generally during each delivery procedure, over the entire time period of the counting procedure, by means of the reduction gear unit, i.e., also in dependence upon the counting frequency.

As a result of this rotational motion of the shaft 14 with the eccentrics 28, the support arms 18, which can be driven in pairs in a form-locking manner with the eccentrics, are subjected to a constant movement over an angle determined by the dimension of the eccentrics. In the ratio of the lengths of the absolute lever arms, starting from the bearing point in the shaft 26 to the arrangement of the shaft 17 with the contact wheels 1.1 to 1.4 and 2.1 to 2.3 and the effective range of the eccentrics 28, all contact wheels 1.1 to 1.4, 2.1 to 2.3 are appropriately moved in an oscillating manner with the axis 17 over the arc measured corresponding to the range of rotation of the shaft 17.

Based on the engagement of the contact wheels 1.1 to 1.4 and 2.1 to 2.3 in decades in the gears 12, all connections between the contact wheels and contact rivets 33 at the contact springs, particularly also the connecting points at the contact wheels which are not moved or inactive during the counting procedure, are subjected to a frictional effect. The frictional procedure describes an area pattern and, thus, significantly increases the switching safety at the contact points.

The mechanical wear phenomena are distributed over a large area and, thus, increase the service life of the contact elements. In the above-described solution, the dependency of the cleaning effect from the friction is put in relation with the counting procedure. However, it is also certainly conceivable that the cleaning motion is derived from switching procedures, zero-position procedures and the like, without significantly departing from the principle of the arrangement for the self-wiping of contacts.

The proposed arrangement makes it possible to mechanically clean prior to every interrogating procedure all the contact points between coding wheels and contact springs through a frictional effect of the two parts on each other in this region. Since counter mechanisms for recording counting procedures must always be dimensioned with respect to the counting capacity in such a way that the individual counting procedures with respect to the active decimals can be picked up with sufficient safety, it happens that the contact wheels of the higher decimals remain inactive over long periods of time. Accordingly, the effect of the mechanical cleaning resulting from rotation is lacking. Particularly for these interrogating units or coding wheels which are subject to only a static load over long periods, the contact cleaning generated by the additional friction proves to be an indispensible measure in order to avoid any erroneous data output also in this region of the counter mechanism.

Because of the additional cleaning effect provided in each counting procedure, the contact pressure on the contact surfaces of the coding wheels can be kept relatively low. This has an extremely advantageous effect on the mechanical wear phenomena which are characteristic for any sliding sensing procedure. Due to the unilateral mounting of the swinging arms, the shaft mounted therein describes a path which is in the form of a circular arc. The contact wheels proper are rotatable and are fixed in their position by the gear engagement in the switching drive driving the wheels. The influence on the contact wheels resulting from the motion of the shaft and the fixing engagement in the switching drive imparts a slight rotational motion on the contact wheels.

Relative to the stationary, point-like contact rivet at the contact spring, an envelope curve of the elliptic type is then described on the conducting contact surface or coding wheels, which curve, of course, stays within the limits of the concentrically arranged paths which can be sensed and within the segmental number valences. The effect resulting from the kinematic relationships is that the contact rivet does not leave behind a groove-like track on the contact surface, but covers, seen in the entirety, a relatively wide band within the concentric contact path for a valence. By expanding the region of contact taken by the point-like contact rivet over a conducting surface, the contact safety and especially the service life of the contact element are significantly improved.

While the foregoing description and drawings represent the preferred embodiments of the present invention, it will be obvious to those skilled in the art that various changes and modifications may be made therein without departing from the true spirit and scope of the present invention.

What is claimed is:

1. In an arrangement for the self-wiping of contacts in multidigit interrogating counters, in which the counter reading data are preferably read through coding wheels to contact wheels and to mechanical sliding contacts which sense the contact wheels, the improvement comprising:

rotatably-mounted contact wheels (1.1, 1.2, 1.3, 1.4, 2.1, 2.2, 2.3) being mounted, independently from the frictional effect caused by the counting procedure during rotation, on a movable shaft;

said contact wheels having a number of contact regions corresponding to different numbers;

eccentrics for controlling movement of said movable shaft in a direction perpendicular to its length, said eccentrics making it possible to move said shaft and said contact wheels (1.1, 1.2, 1.3, 1.4, 2.1, 2.2, 2.3) in an oscillating manner; and contact springs against which said contact wheels operate in said oscillating manner for sensing individual ones of the different numbers, said contact wheels being arranged to be moved by said eccentrics so that said contact springs remain within those contact regions of said contact wheels which regions correspond to the numbers being read by the counter.

2. An arrangement for the self-wiping of contacts according to claim 1, including swinging support arms for receiving the ends of said shaft bearing said contact wheels (1.1, 1.2, 1.3, 1.4, 2.1, 2.2, 2.3), and wherein a driven shaft is included, said eccentrics being mounted on said driven shaft, and said swinging support arms are arranged to be swung by said eccentrics on said driven shaft.

3. An arrangement for the self-wiping of contacts according to claim 1, said contact springs include contact rivets, said contact springs being arranged rigidly relative to said contact wheels so that between the contact rivets of said contact springs and the contact regions of the oscillatingly moved contact wheels, there is created a frictional effect which can be expanded over each of the contact regions wherein the areas of contact between the contact rivets and the contact regions of the contact wheels can be increased.

4. An arrangement for the self-wiping of contacts according to claim 1, including a reduction gear unit coupled to a drive mechanism which operates during a counting time period, and a driven-shaft, said eccentrics being fixedly mounted on said driven shaft wherein said driven shaft is constantly in drive connection to the drive mechanism through said reduction gear unit during said counting time period.

* * * * *